US005561434A

United States Patent [19]

Yamazaki

[11] Patent Number: 5,561,434

[45] Date of Patent: Oct. 1, 1996

[54] DUAL BAND PHASED ARRAY ANTENNA APPARATUS HAVING COMPACT HARDWARE

[75] Inventor: Tsugio Yamazaki, Tokyo, Japan

[73] Assignee: NEC Corporation, Japan

[21] Appl. No.: 258,512

[22] Filed: Jun. 10, 1994

[30] Foreign Application Priority Data

Jun. 11, 1993 [JP] Japan ..... 5-140415

[51] Int. Cl.[6] ..... H01Q 1/38; H01Q 3/30; H01Q 21/28

[52] U.S. Cl. ..... 343/700 MS; 343/853; 342/372; 342/375

[58] Field of Search ..... 343/700 MS, 853; 342/372, 375; H01Q 1/38, 21/00, 21/28, 3/28, 3/30, 25/00

[56] References Cited

U.S. PATENT DOCUMENTS

| | | | |
|---|---|---|---|
| 4,605,932 | 8/1986 | Butscher et al. | 343/700 MS |
| 4,864,314 | 9/1989 | Bond | 343/700 MS |
| 5,001,493 | 3/1991 | Patin et al. | 343/700 MS |
| 5,206,655 | 4/1993 | Caille et al. | 343/70 MS |
| 5,243,354 | 9/1993 | Stern et al. | 343/700 MS |
| 5,386,214 | 1/1995 | Sugawa | 343/700 MS |

FOREIGN PATENT DOCUMENTS

| | | |
|---|---|---|
| 4-40003 | 2/1992 | Japan . |
| 4-122104 | 4/1992 | Japan . |

OTHER PUBLICATIONS

"Superimposed Dichroic Microstrip Antenna Arrays", by J. R. James et al, IEE Proceedings, vol. 135, Pt. H. No. 5, Oct. 1988.

"Antenna Engineering Handbook, Second Edition", by Richard C. Johnson et al, McGraw–Hill Book Company, 1984, pp. 2–34 through 2–39, 20–15 through 20–17, 21–15 through 21–18.

*Primary Examiner*—Michael C. Wimer

*Attorney, Agent, or Firm*—Ostrolenk, Faber, Gerb & Soffen, LLP

[57] ABSTRACT

In a dual band array antenna apparatus having a plurality of first phased array antenna elements for a low frequency and a plurality of second phased array antenna elements for a high frequency, one transceiver module is provided for a number of the phased array first antenna elements, and microstrip lines of the first phased array antenna elements are changed to obtain a desired phase distribution at the first phased array antenna elements. Also, one transceiver module is provided for each of the second phased array antenna elements.

14 Claims, 13 Drawing Sheets

| Fig. 5A | Fig. 5B |
|---|---|

DUAL BAND PHASED ARRAY ANTENNA APPARATUS HAVING COMPACT HARDWARE

BACKGROUND OF THE INVENTION

1. Field of the Invention

The present invention relates to a dual band phased array antenna apparatus for a radar or the like.

2. Description of the Related Art

Phased array antenna elements have been used for generating a scanning beam. In this case, each of the antennas are powered by different phased power signals. Generally, since the scanning beam is a high frequency pencil-type beam, a large search time for the entire elevation and azimuth angle coverage is required, while high acquisition and tracking performance for three-dimensional information regarding a near object is maintained. This will be explained later in detail.

Note that, in order to reduce the search time for the entire elevation and azimuth angle coverage in a long distance (range) area, a low frequency antenna can be used. That is, a maximum radar distance (range) of the low frequency antenna can be larger than that of the high frequency antenna for the following reasons. First, the output power of a power amplifier in a transmitter of a transceiver module can be high. Secondly, the noise figure of a low noise amplifier in a receiver of the transceiver module can be low. Thirdly, the loss of feed lines can be small. Fourthly, the propagation loss in the air is small. As a result, the low frequency scanning beam can propagate a long distance and be received from a distant object to form two-dimensional information. However, the resolution and angle accuracy of a radar system using the low frequency scanning beam is poor, and as a result, the acquisition and tracking performance for a near object is reduced.

In order to make use of both the high acquisition and tracking performance of the high frequency scanning beam for a near object and the small search time for the entire elevation and azimuth angle coverage by the low frequency scanning beam for a distant object, dual band array antenna elements have been known (see: J. R. James et al.: "Superimposed dichroic microstrip antenna arrays", IEE. PROCEEDINGS, Vol. 135, Pt. H, No. 5, Oct. 1988). That is, a plurality of first array antenna elements for the low frequency radiation beam and a plurality of second array antenna elements for the high frequency radiation beam are superimposed on each other. This will be explained later in detail. Note that the above-mentioned document does not disclose an arrangement of transceiver modules to the array antenna elements. One approach to this is that each of the array antenna elements may be connected to one transceiver module. In this case, however, the antenna apparatus is increased in size and cost, since the antenna apparatus is too complex. At worst, it is impossible to arrange all of the necessary transceiver modules due to the mounting space therefor. Also, even when a low frequency scanning beam is used, a searching time for the entire elevation and azimuth angle coverage regarding a distant object is still large, since the low frequency radiation beam is a pencil-type.

SUMMARY OF THE INVENTION

It is, therefore, an object of the present invention to provide a dual band phased array antenna apparatus having compact hardware, to reduce the size and cost thereof.

Another object is to reduce the search time for the entire elevation and azimuth angle coverage with the low frequency radiation beam.

According to the present invention, in a dual band array antenna apparatus having a plurality of first phased array antenna elements for a low frequency and a plurality of second phased array antenna elements for a high frequency, one transceiver module is provided for a number of the phased array first antenna elements, and microstrip line of the first phased array antenna elements are changed to compensate for the transmission delay time among them. Also, one transceiver module is provided for each of the second phased array antenna elements. As a result, since the number of transceiver modules is reduced, the size and cost of the antenna apparatus can be reduced. Also, since the first phased array antenna elements can be operated in a specific amplitude and phase to form a fan-type beam if this antenna apparatus is applied to a cylindrical type antenna or the like, a fan-type scanning beam can be formed, thus reducing the search time for the entire elevation and azimuth angle coverage.

BRIEF DESCRIPTION OF THE DRAWINGS

The present invention will be more clearly understood from the description as set forth below, as compared with the prior art, with reference to the accompanying drawings, wherein.

DESCRIPTION OF THE PREFERRED EMBODIMENT

Before the description of the preferred embodiment, prior art antenna apparatuses will be explained with reference to FIGS. 1, 2 and 3.

Figure 1:
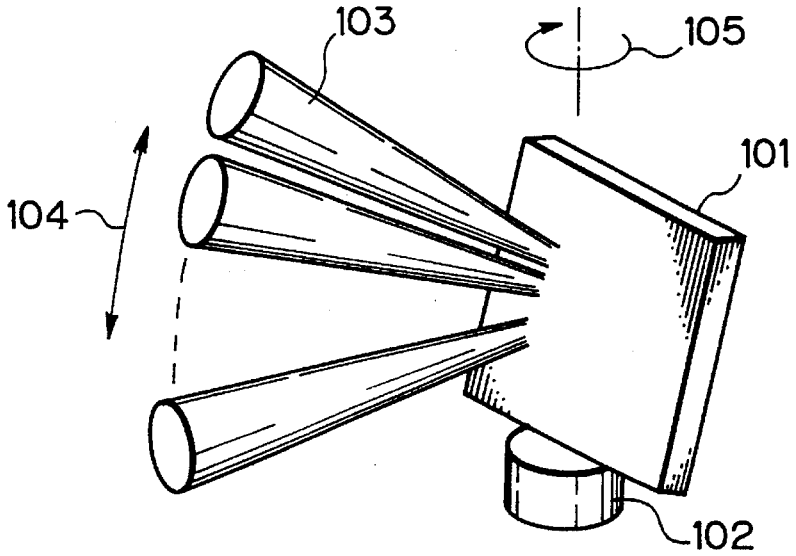
Fig. 1 PRIOR ART
FIG. 1 is a perspective view illustrating a first: prior art phased array antenna apparatus.

In FIG. 1, which illustrates a first prior art antenna apparatus, a planar phased array antenna apparatus includes a plane radiation portion 101 rotatably fixed at a pedestal 102. A pencil-type scanning beam 103 emitted from the plane radiation portion 101 is scanned electronically in an elevation direction 104, and is scanned mechanically in an azimuth direction 105.

Figure 2:
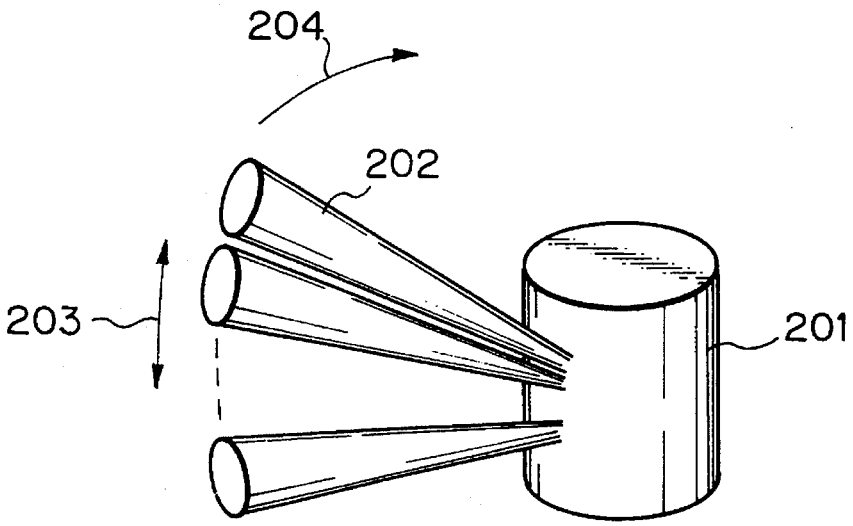
Fig. 2 PRIOR ART
FIG. 2 is a perspective view illustrating a second prior art phased array antenna apparatus.

In FIG. 2, which also illustrates a prior art antenna apparatus, a cylindrical phased array antenna apparatus includes a cylindrical radiation portion 201. A pencil-type scanning beam 202 emitted from the cylindrical radiation portion 201 is scanned electronically in an elevation direction 203, and is scanned electronically in an azimuth direction 204.

Figure 3:
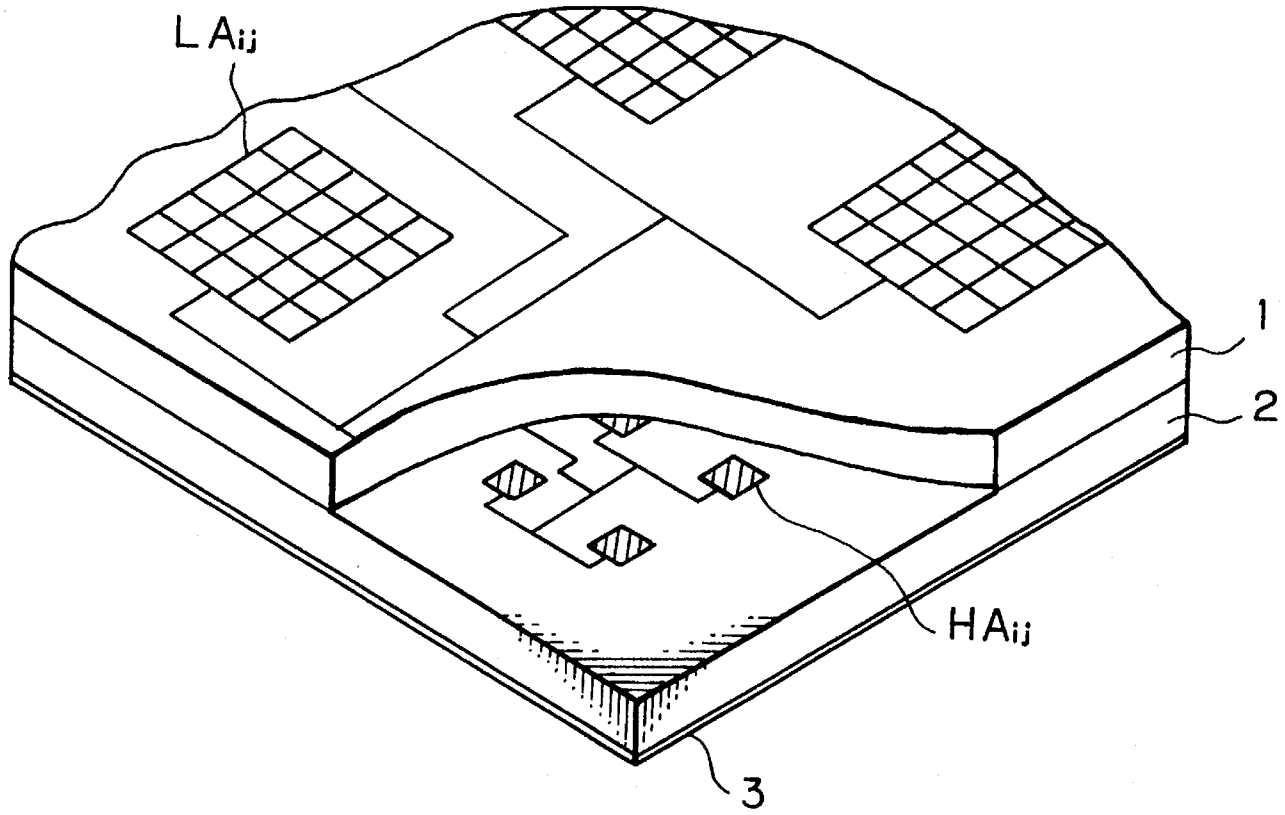
Fig. 3 PRIOR ART
FIG. 3 is a partly cut-away perspective view illustrating a third prior art antenna apparatus.

In order to generate both a high frequency. pencil-type scanning beam for a near object and a low frequency pencil-type scanning beam for a distant object, an antenna apparatus as illustrated in FIG. 3 is known (see the above-mentioned document). In FIG. 3, reference numeral $LA_{ij}$ (i, j,=1, 2, . . . ) designates a mesh-type low frequency antenna element, and reference numeral $HA_{ij}$ (i, j,=1, 2, . . . ) designates a patch-type high frequency antenna element. The low frequency antenna elements $LA_{ij}$ are formed on an upper face of a dielectric substrate 1, and the high frequency antenna elements $HA_{ij}$ are formed on an upper face of a dielectric substrate 2. Also, formed on a lower face of the dielectric substrate 2 is a ground conductor 3. Since the low frequency antenna element a mesh-type, a radiation beam emitted from the: high antenna frequency antenna elements $HA_{ij}$ can pass through the low frequency antenna elements $LA_{ij}$. Note that, the high frequency antenna elements $HA_{ij}$ can be formed on the upper face of the dielectric substrate 1, and the low frequency antenna elements $LA_{ij}$ can be formed on the upper face of the dielectric substrate 2. Also,, both of the antenna elements $LA_{ij}$ and $HA_{ij}$ can be patch-type (see JP-A-Hei 4-40003).

In the antenna apparatus of FIG. 3, however, as stated above, there may be one approach that each of the antenna elements $LA_{ij}$ and $HA_{ij}$ may be connected to one transceiver module (not shown). In this case, however, the size and cost of the antenna apparatus are increased. Also, since the low frequency scanning beam is a pencil-type, searching for the entire elevation and azimuth angle coverage regarding a distant object is still large.

Figure 4A:
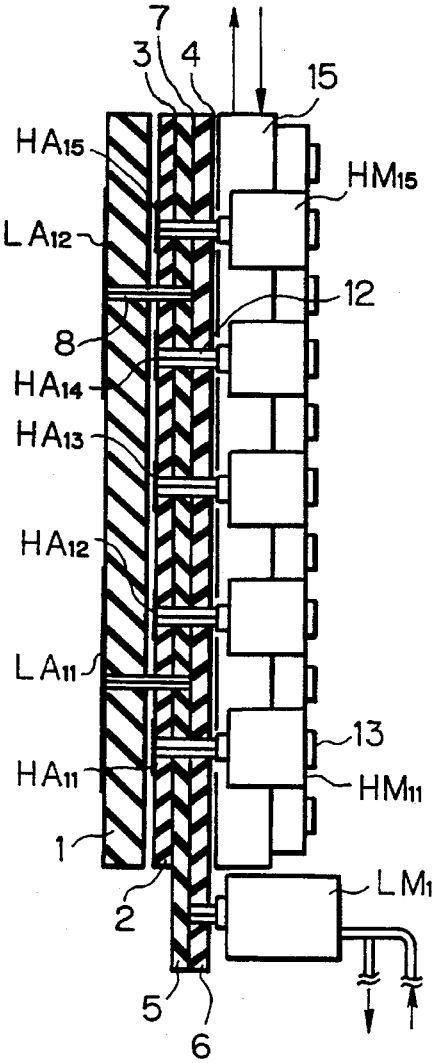
FIG. 4A is a cross-sectional view illustrating an embodiment of the antenna apparatus according to the present invention.
Figure 4B:
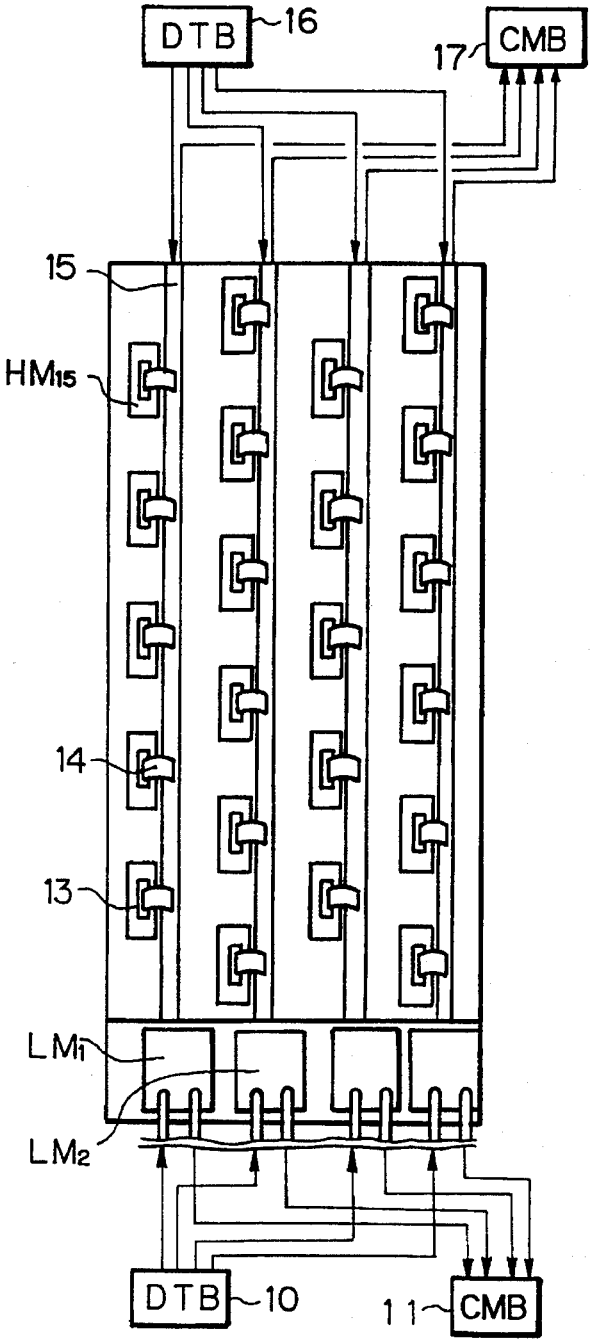
FIG. 4B is a backside view of the antenna apparatus of FIG. 4A.

FIG. 4A is a cross-sectional view illustrating an embodiment of the antenna apparatus and FIG. 4B is a back side view of FIG. 4A. In FIGS. 4A and 4B, a ground plane 4, two dielectric substrates 5 and 6, and a microstrip line pattern 7 are added to the elements of FIG. 3. The antenna elements $LA_{ij}$ (i, j,=1, 2), the dielectric substrates I and 2, and the ground plane 3 form a transmission and receiving system for a low frequency. One column of the low frequency antenna elements such as $LA_{11}$, $LA_{12}$, . . . are connected via feed lines 8 to one transceiver module $LM_1$ which is connected to an external distributor 10 and an external combiner 11.

On the other hand, each of the high frequency antenna elements $HA_{ij}$ is connected via a feed line 12 to one transceiver module $HM_{ij}$. The transceiver module $HM_{ij}$ is connected via a connector 13, a cable 14 and a transmission line 15 to an external distributor 16 and an external combiner 17.

In FIGS. 4A and 4B, a plurality of the low frequency antenna elements such as one column of the low frequency antenna elements are connected to one transceiver module, thus reducing the number of transceiver modules. In this case, the amplitudes and phases among the low frequency antenna elements $LA_{ij}$ are adjusted by a triple plate type distributor/combiner formed by the microstrip line pattern 7, the ground planes 3 and 4, and the dielectric substrate 5 and 6 sandwiching the microstrip line pattern 7.

Figures 5, 5A:
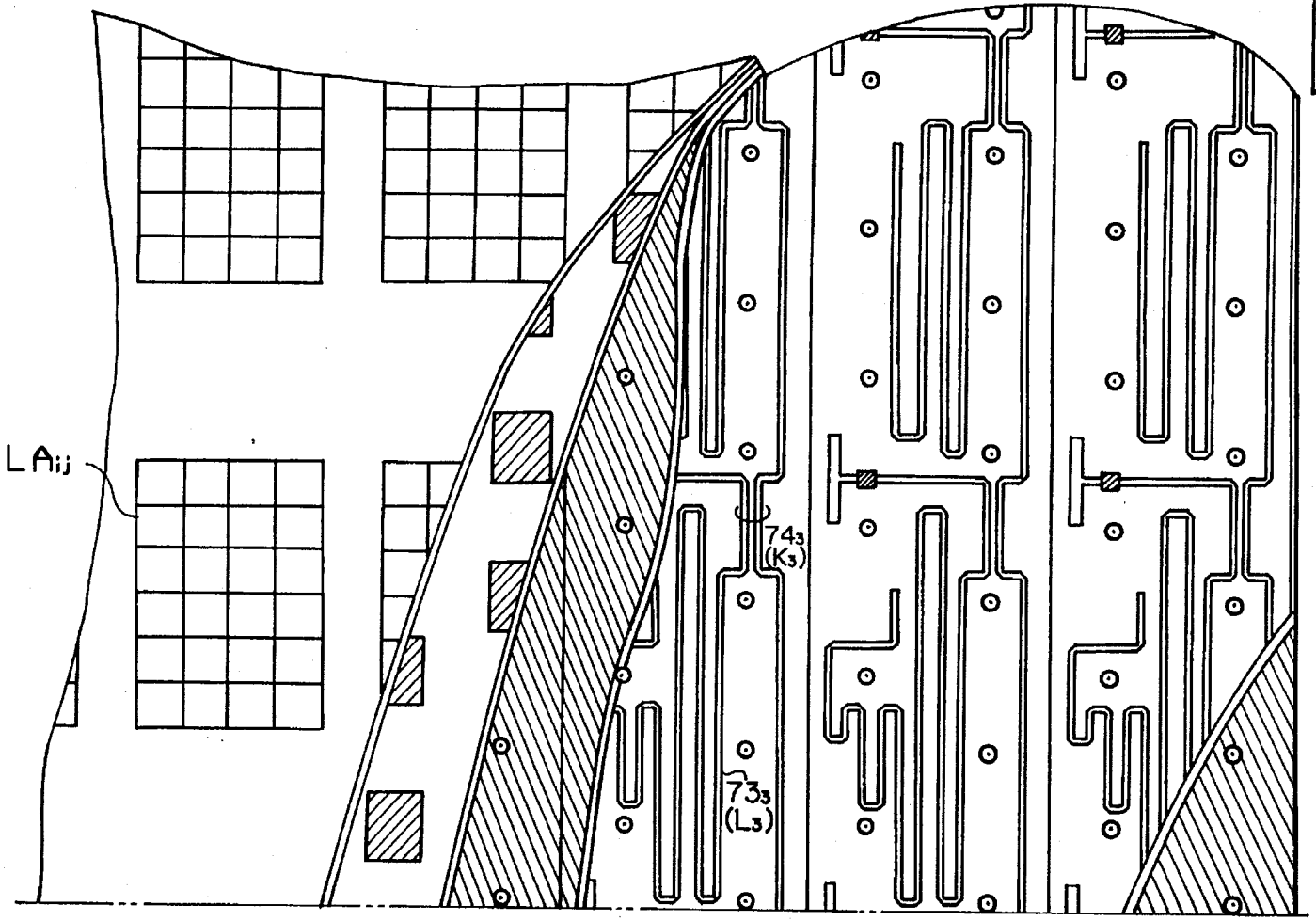
FIGS. 5A and 5B are each a partly cut-away enlarged plan view of the antenna apparatus of FIG. 4A.
Figure 5B:
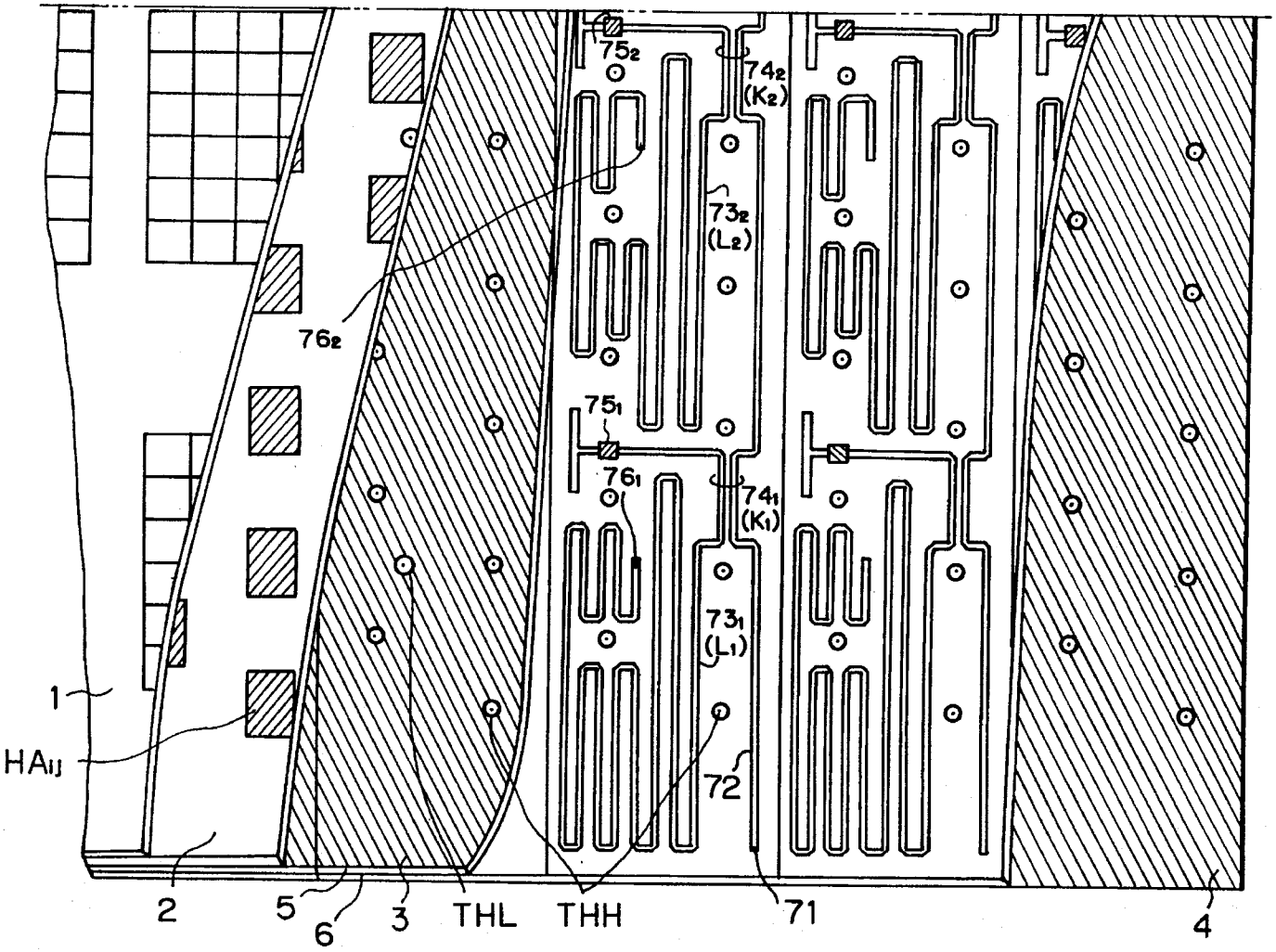

Referring to FIGS. 5A and 5B, which is a detailed diagram of the microstrip line pattern 7 of FIG. 4A, the microstrip line pattern 7 for one column is constructed by an input/output terminal 71 connected to the external distributor 10 and the combiner 11 (FIG. 4B), a microstrip line 72, microstrip lines $73_1$. $73_2$, . . . , which are connected by couplers $74_1$, $74_2$, . . . , respectively, to the microstrip line 72, chip resistors $75_1$, $75_2$, . . . , serving as resistive terminators connected to the microstrip lines $73_1$, $73_2$, . . . , respectively, and input/output terminals $76_1$, $76_2$, . . . connected via the feed line 12 (FIG. 4A) to the low frequency antenna elements $LA_{11}$, $LA_{12}$, . . . , respectively. Note that a chip resistor 77 (shown not in FIG. 5A and 5B, but shown in FIG. 6) serving as a resistive terminator is connected to an end of the microstrip line 72.

A transmission operation is performed upon the microstrip line pattern 7 as follows. That is, a transmission signal is supplied from the distributor 10 (FIG. 4B) via the transceiver module $LM_1$ and the input/output terminal 71 to the microstrip line 72. As a result, the transmission signal is distributed in accordance with coupling factors $K_1$, $K_2$, . . . of the couplers $74_1$, $74_2$, . . . to the microstrip lines $73_1$, $73_2$, . . . . Further, the transmission signals on the microstrip lines $73_1$, $73_2$, . . . propagate thereon with delay times in accordance with lengths $L_1$, $L_2$, . . . thereof.

Similarly, a receiving operation is performed upon the microstrip line pattern 7 as follows. That is, a receiving signal from each of the low frequency antenna elements $LA_{11}$, $LA_{12}$, . . . is supplied via the input/output terminals $76_1$, $76_2$, . . . to the microstrip lines $73_1$, $73_2$, . . . , respectively. Also, in this case, the receiving signals on the microstrip lines $73_1$, $73_2$, . . . propagate thereon with the delay times in accordance with the lengths $L_1$, $L_2$, . . . thereof. Then, the receiving signals are supplied to the microstrip line 72 in accordance with the coupling factors $K_1$, $K_2$, . . .of the couplers $74_1$, $74_2$, . . . . Further, the receiving signals on the microstrip line 72 are supplied via the input/output terminal 71 and the transceiver module $LM_1$ to the combiner 11 (FIG. 4B).

In FIGS. 5A and 5B, the lengths $L_1$, $L_2$, . . . of the microstrip lines $73_1$, $73_2$, . . . are determined so as to obtain a desired phase distribution at the low frequency antenna elements $LA_{11}$, $LA_{12}$, . . . . For example, $L_1>L_2>$. . .

Also, the coupling factors $K_1$, $K_2$, . . . of the couplers $74_1$, $74_2$, . . . are determined to obtain a desired amplitude distribution at the low frequency antenna elements $LA_{11}$, $LA_{12}$, . . . . For example, $K_1<K_2<$. . . .

In FIG. 5B, note that reference THL designates through holes through which the feed lines 8 (FIG. 4A) pass, and reference THH designates through holes through which the feed lines 12 (FIG. 4A) pass. The strip lines 72, $73_1$, $73_2$, . . . bypass the through holes THL and THH, thus preventing the deterioration of transmission of the signals.

Figure 6:
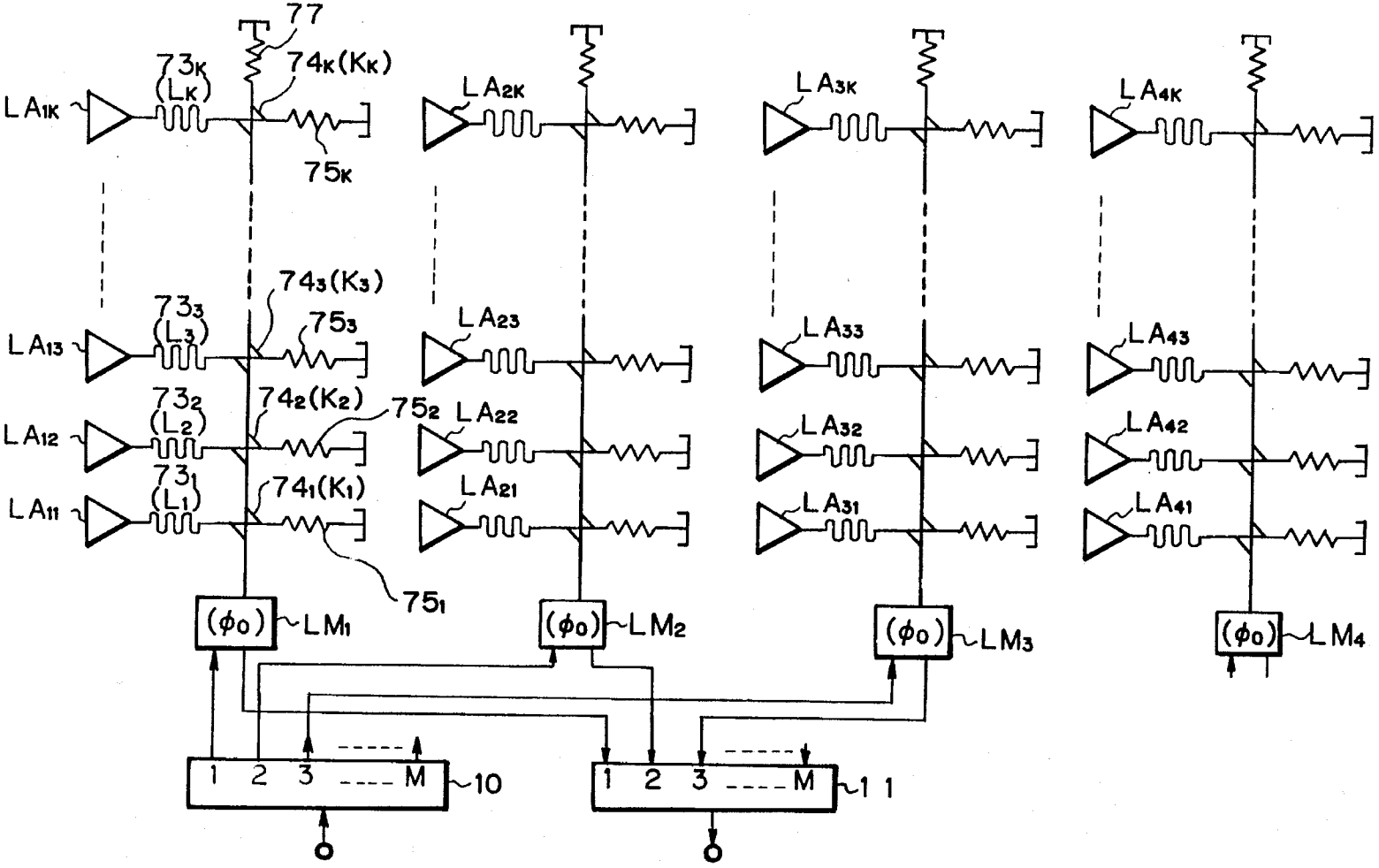
FIG. 6 is a circuit diagram of a low frequency phased antenna portion of the antenna apparatus of FIG. 4A.

In FIG. 6, which is a circuit diagram for the low frequency phased array antenna portion of the antenna apparatus of FIG. 4A, one column of the low frequency antenna elements $LA_{11}$, $LA_{12}$, $LA_{13}$, . . . , $LA_{1K}$ are connected to the transceiver module $LM_1$. Similarly, one column of the low frequency antenna elements $LA_{21}$, $LA_{22}$, $LA_{23}$, . . . , $LA_{2K}$, are connected to the transceiver module $LM_2$. As explained above, the lengths $L_1, L_2, L_3, \ldots, L_k$ of the microstrip lines $73_1, 73_2, 73_3, \ldots, 73_k$ are determined to obtain a desired phase distribution, to thereby form a fan-type beam.

Also, the coupling factors $K_1, K_2, K_3, \ldots K_k$ of the couplers $74_1, 74_2, 74_3, \ldots, 74_K$ are determined to obtain a desired amplitude distribution, to thereby a fan-type beam.

Also, in case of a planer array antenna where a beam nose is positioned on a broad side, the transceiver modules $LM_1$, $LM_2, \ldots$ have the same configuration determined by a phase shift amount $\phi o$.

As is illustrated in FIG. 6, the microstrip line pattern 7 formed by the microstrip line 72, the microstrip lines $73_1$, $73_2, 73_3, \ldots 73_K$, the coupler $74_1, 74_2, 74_3, \ldots 74_K$, the chip resistor $75_1, 75_2, 75_3, \ldots, 75_K$, and the chip resistor 77 constitute one distributor/combiner for the low frequency antenna elements $LA_{11}, LA_{12}, LA_{13}, \ldots, LA_{1K}$.

Figure 7:
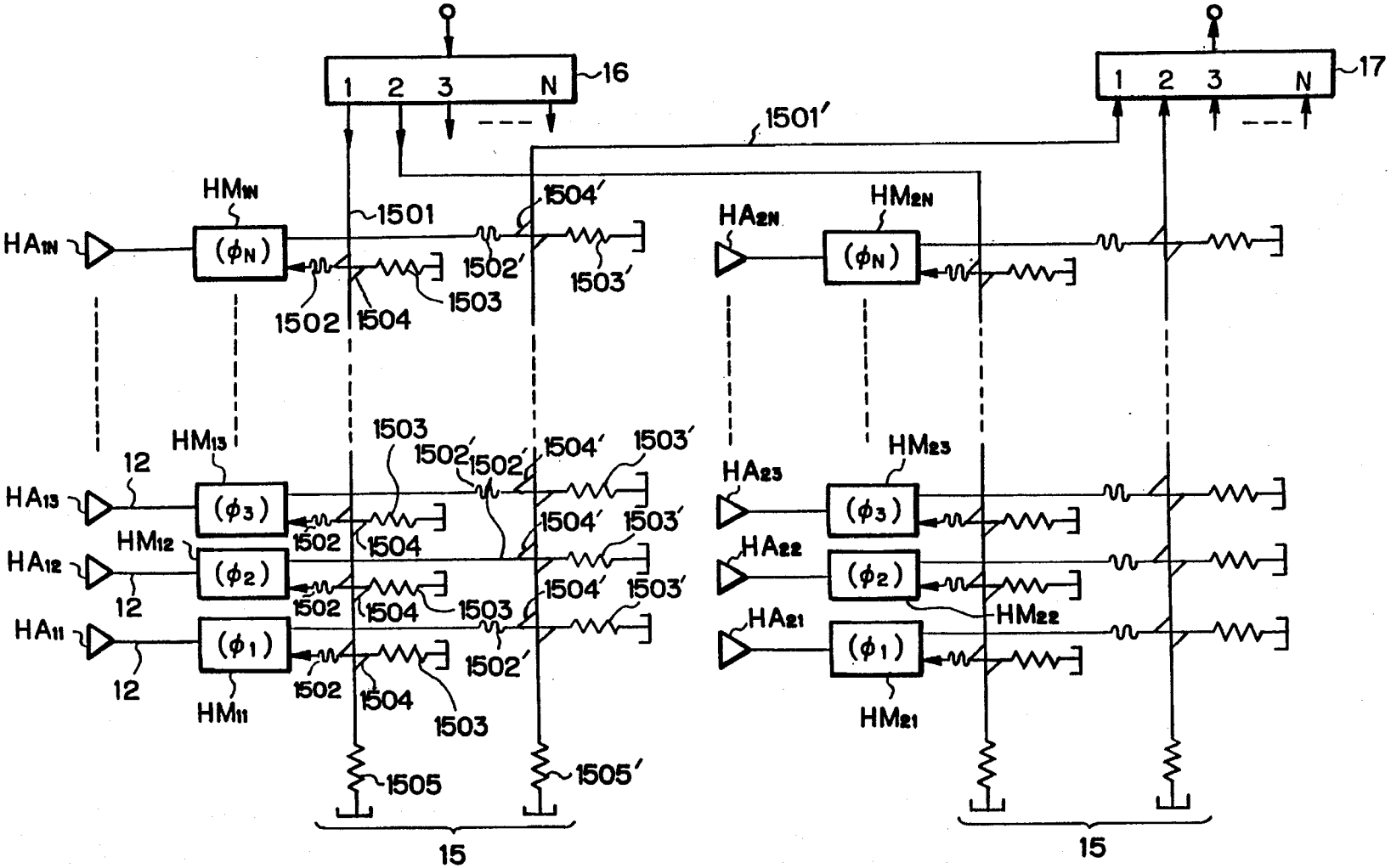
FIG. 7 is a circuit diagram of a high frequency phased antenna portion of the antenna apparatus of FIG. 4A.
Figure 8:
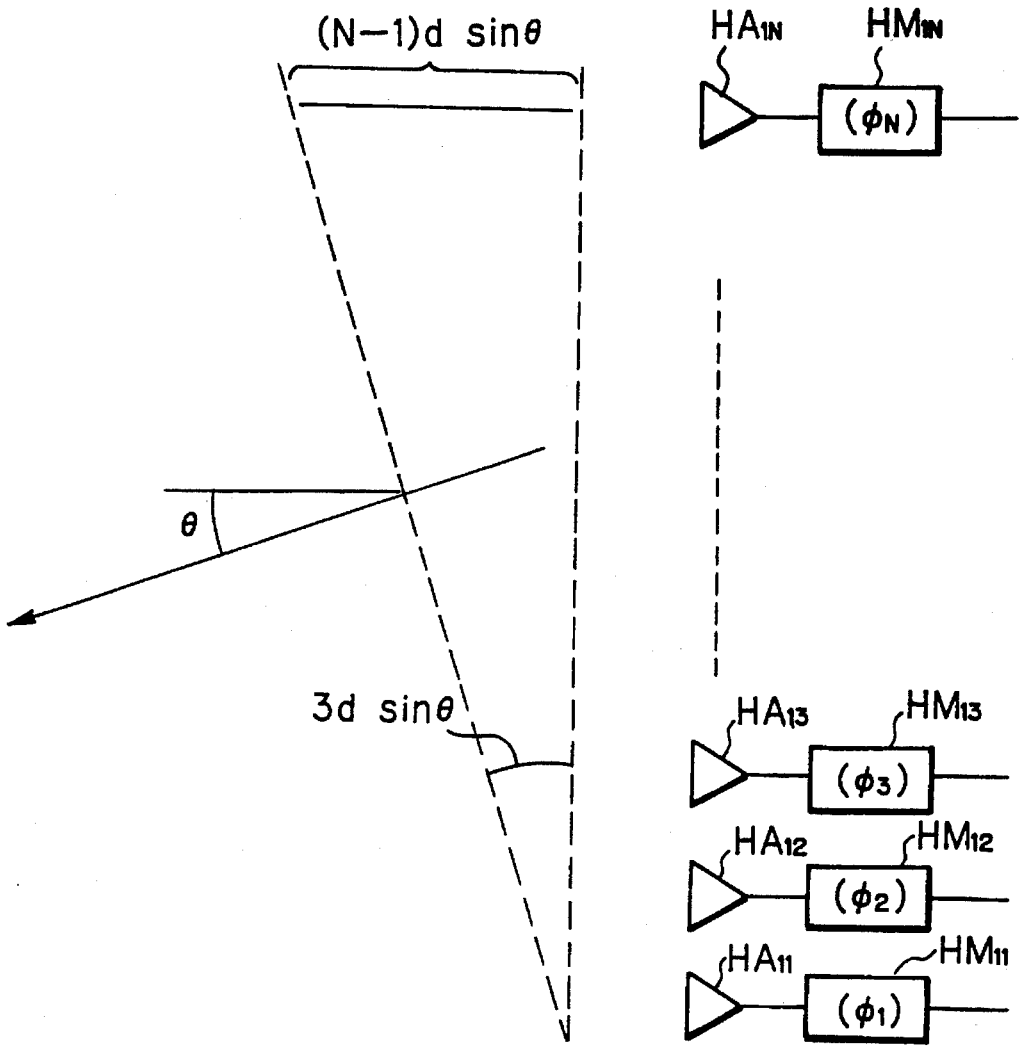
FIG. 8 is a diagram showing the phase distribution of the modules of FIG. 7.

The transmission line 15 of FIGS. 4A and 4B includes conductors and dielectric substrates to form one distributor/combiner as illustrated in FIG. 7, which is a circuit diagram of the high frequency phased array antenna portion of the antenna apparatus of FIG. 4A. For example, the transmission line 15 for the high frequency antenna elements $HA_{11}$, $HA_{12}, HA_{13}, \ldots, HA_N$ includes a conductor 1501, conductors 1502 connected to the transceiver modules $HM_{11}$, $HM_{12}, HM_{13}, \ldots HM_{1N}$, chip resistors 1503 serving as resistive terminators, couplers 1504 between the conductors 1502 and the chip resistors 1503, and a chip resistor 1505 serving as a resistive terminator, to form one distributor. Also, the transmission line 15 for the high frequency antenna elements $HA_{11}, HA_{12}, HA_{13}, \ldots, HA_N$ includes a conductor 1501', conductors 1502' connected to the transceiver modules $HM_{11}, HM_{12}, HM_{13}, \ldots, HM_{1N}$, chip resistors 1503' serving as resistive terminators, couplers 1504' between the conductors 1502' and the chip resistors 1503', and a chip resistor 1505' serving as a resistive terminator, to form one combiner. In this case, the length of each of the conductors 1502 and 1502' is the same, the transceiver modules $HM_{11}$, $HM_{12}, HM_{13}, \ldots, HM_{1N}$ have different configurations determined by phase shift amounts $\phi 1, \phi 2, \phi 3, \ldots \phi N$. For example, as shown in FIG. 8, in a linear array, in order to generate a beam with a narrow width, the values $\phi_i$ (i=1~N) are given by $$\phi_i = (2\pi/\lambda)\ (n-1)\ d \sin\theta + \Delta\phi_i$$

where $\lambda$ is a wavelength in free space;

d is a distance between the high frequency antenna elements;

$\theta$ is a direction of the beam; and $\Delta\phi_i$ is a correction value determined by the antenna elements, the transmission lines, phase shifters, and the like.

Figure 9:
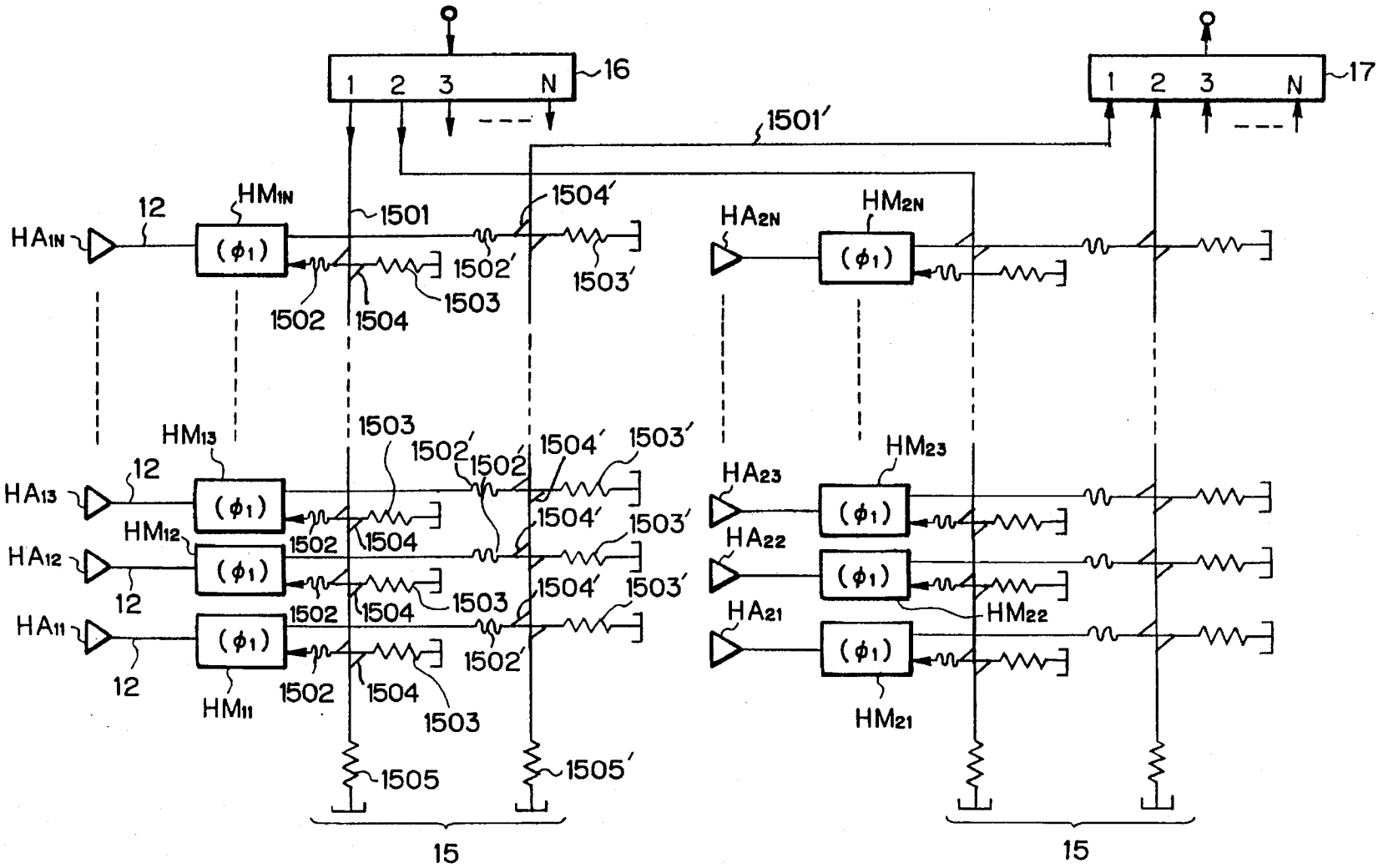
FIG. 9 is a circuit diagram illustrating a modification of the circuit of FIG. 7.

However, as illustrated in FIG. 9, it is possible for the transceiver modules $HM_{11}, HM_{12}, HM_{13}, \ldots, HM_{1N}$ to have the same configuration determined by a phase shift amount $\phi$. In this case, the lengths of the conductors 1502 and 1502' are determined so as to obtain a desired phase distribution at the high frequency antenna elements $HA_{11}$, $HA_{12}, \ldots$. Thus, the above-mentioned phase distribution is obtained in the same way as in FIG. 7.

Also, the coupling factors of the couplers 1504 and 1504' ... are determined to obtain a desired amplitude distribution at the high frequency antenna element $HA_{11}, HA_{12}, \ldots$.

Figure 10:
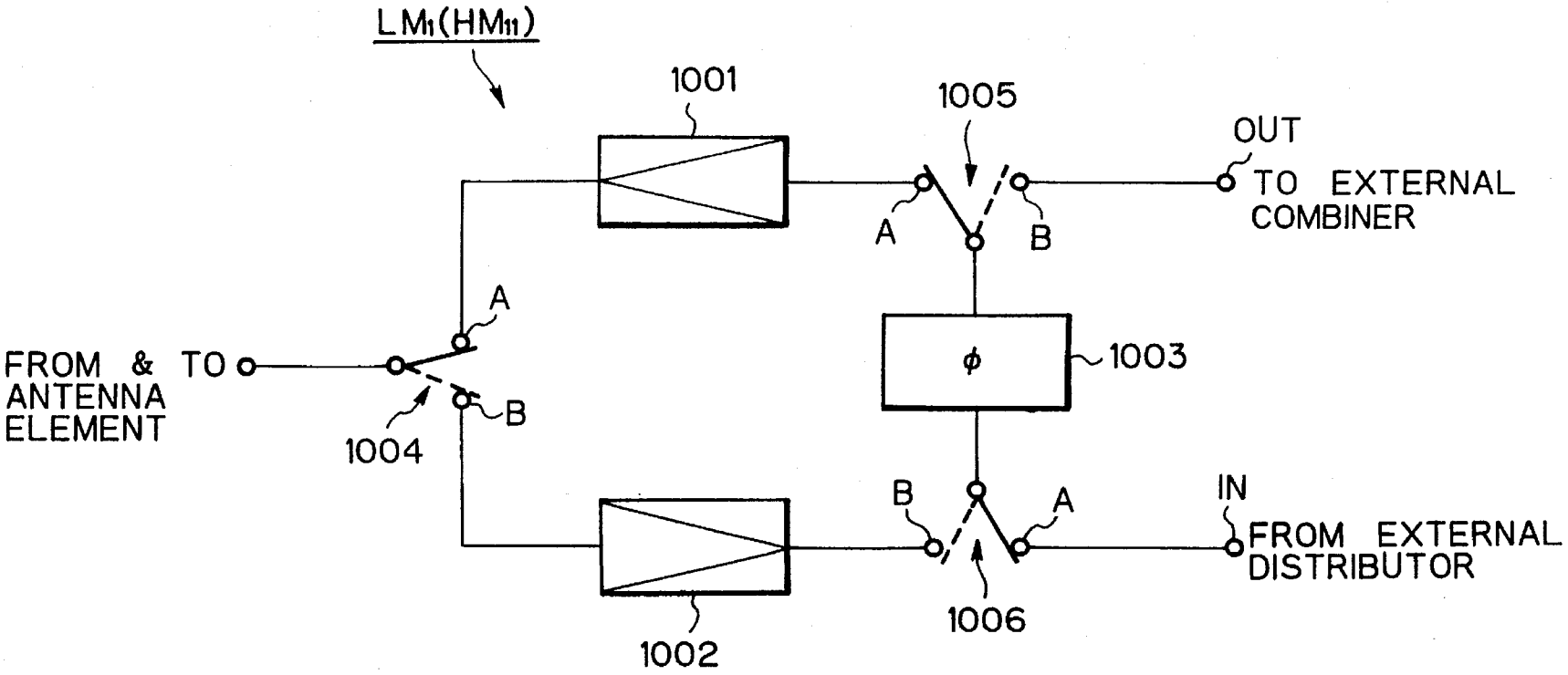
FIG. 10 is a circuit diagram of the transceiver module of FIG. 4A.

In FIG. 10, which is a detailed circuit diagram of the transceiver module, for example, $LM_1$ or $HM_{11}$, reference numeral 1001 designates a power amplifier, 1002 designates a low noise amplifier, 1003 designates a phase shifter having a phase amount $\phi$, and 1004, 1005 and 1006 designate switches. During a transmitting mode, the switches 1004, 1005 and 1006 fall to their terminals A. As a result, a transmission signal supplied to an input terminal IN is supplied via the switch 1006 to the phase shifter 1003, thus adjusting the phase of the transmission signal. Further, the transmission signal is transmitted via the switch 1005 to the power amplifier 1001, and is amplified by the power amplifier 1001. Then, the amplified signal is transmitted via the switch 1004 to the corresponding antenna element. On the other hand, during a receiving mode, the switches 1004, 1005 and 1006 fall to their terminals B. As a result, a receiving signal from the corresponding antenna element is transmitted via the switch 1004 to the low noise amplifier 1002, and is amplified by the low noise amplifier 1002. Also, the amplified signal is transmitted via the switch 1006 to the phase shifter 1003, thus adjusting the phase of the amplified signal. Further, the output signal of the phase shifter 1003 is transmitted via the switch 1005 to an output terminal OUT.

In the above-described embodiment, use is made of the difference in transmission loss between a low frequency signal and a high frequency signal. That is, since the transmission loss of the low frequency signal is smaller than that of the high frequency signal, the distance between each of the low frequency antenna elements $LA_{11}, LA_{12}, \ldots$ and their corresponding transceiver module $LM_1$ can be enlarged as compared with that between each of the high frequency antenna elements such as $HA_{11}, HA_{12}, \ldots$ and its corresponding transceiver modules such as $HM_{11}, HM_{12}, \ldots$. In addition, the output power of the power amplifier 1001 can be made higher by using semiconductor technology in the transceiver module such as $LM_1, LM_2, \ldots$, as compared with in the transceiver module such as $HM_{11}, HM_{12}, \ldots$. Further, the noise figure of the low noise amplifier 1002 can be reduced by using semiconductor technology in the transceiver module such as $LM_1, LM_2, \ldots$, as compared with in the transceiver module such as $HM_{11}, HM_{12}, \ldots$. Thus, the distance between the low frequency antenna element and its corresponding transceiver module can be further enlarged. On the other hand, since the transmission loss of the high frequency signal is large, the distance between the high frequency antenna element and its corresponding transceiver module is as short as possible.

Figure 11:
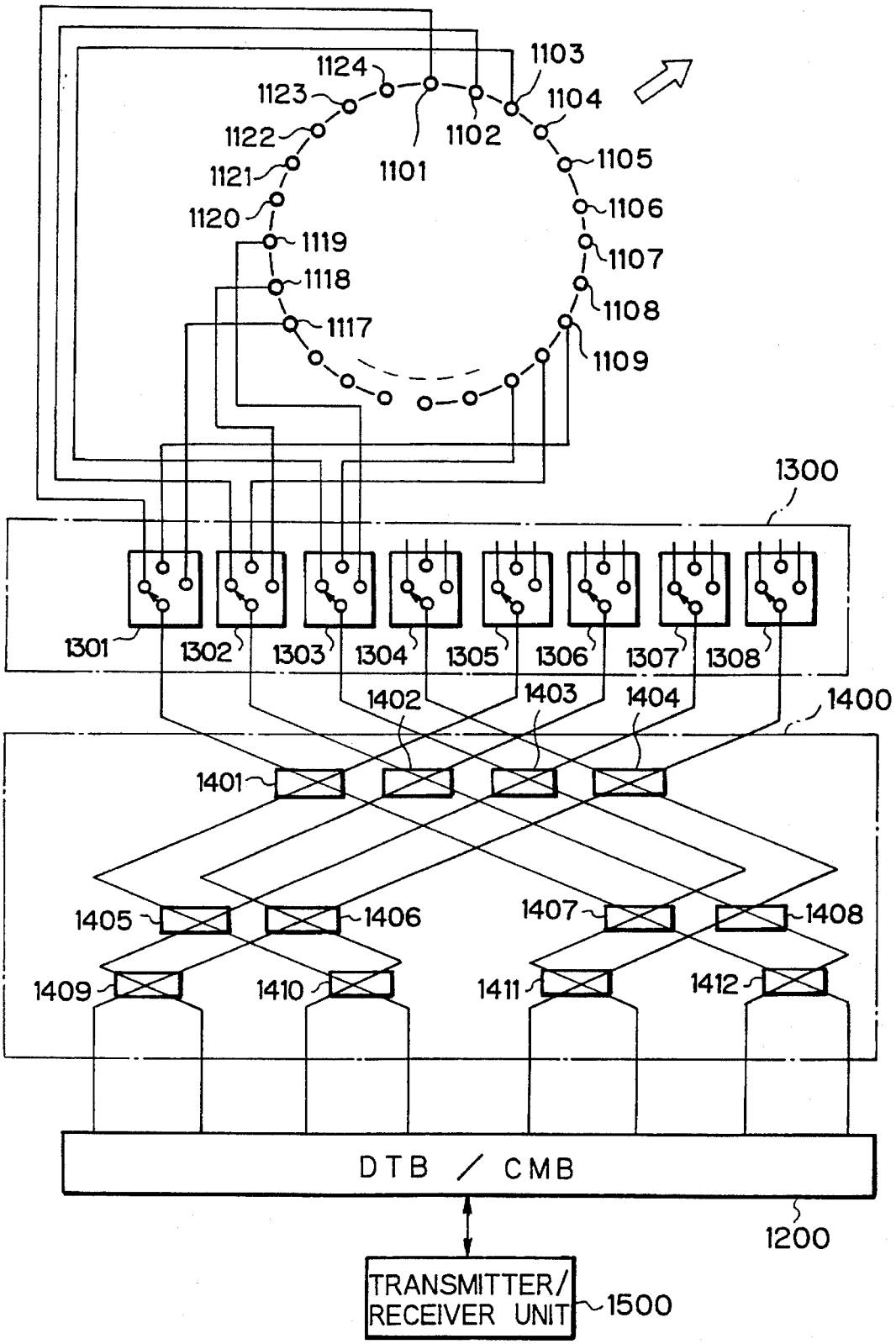
FIG. 11 is a constitutional diagram illustrating a radar system where the antenna apparatus of FIG. 4A is applied to a cylindrical type antenna.
Figure 12A:
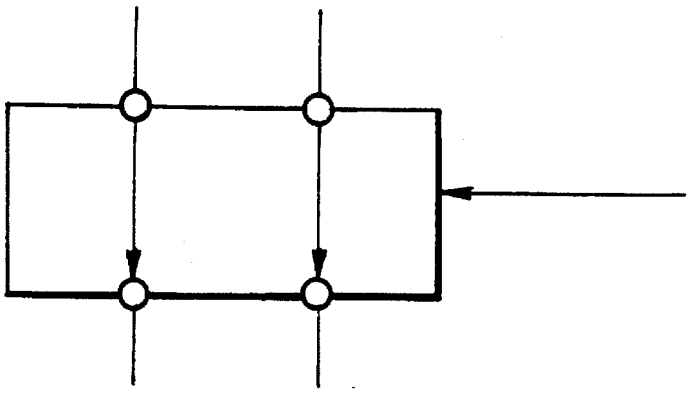
FIG. 12A and 12B are diagrams illustrating the state of the transfer switch of FIG. 11.
Figure 12B:
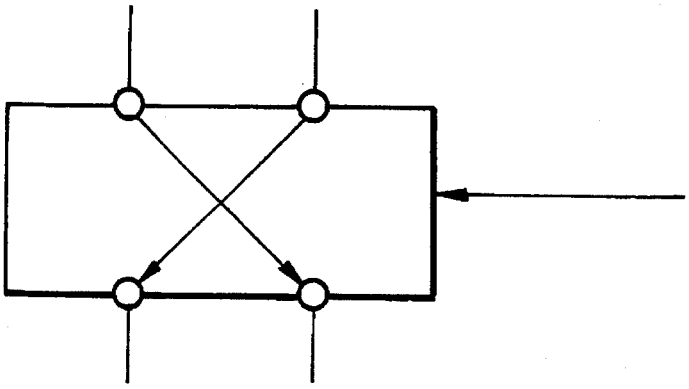

The above-described embodiment is applied to a cylindrical type array as illustrated in FIG. 11. In FIG. 11, twenty four column arrays 1101 through 1124 are provided. Each of the column arrays 1101 through 1124 corresponds to one column of the low frequency phased array portion as illustrated in FIG. 6 or one column of the high frequency phased array portion as illustrated in FIG. 7 (9). Also, provided between the column arrays 1101 through 1124 and a distributor/combiner 1200 which corresponds to the external distributor 10 and the external combiner 11 of FIG. 6 or the external distributor 16 and the external combiner 17 of FIG. 7 (9) are a single pole triple throw switching circuit 1300 and a switching network 1400. The switching circuit 1300 includes eight single pole triple throw switches 1301 through 1308. Also, the switching network 1400 includes twelve transfer switches 1401 through 1412 each having two states as shown in FIGS. 12A and 12B. Also, a transmitter/receiver unit 1500 is connected to the distributor/combiner 1200. Note that the antenna apparatus of FIG. 11 includes a low frequency phased array antenna portion and a high frequency phased array antenna portion each having a similar configuration; however, only one is illustrated for simplification of illustration.

Figure 13:
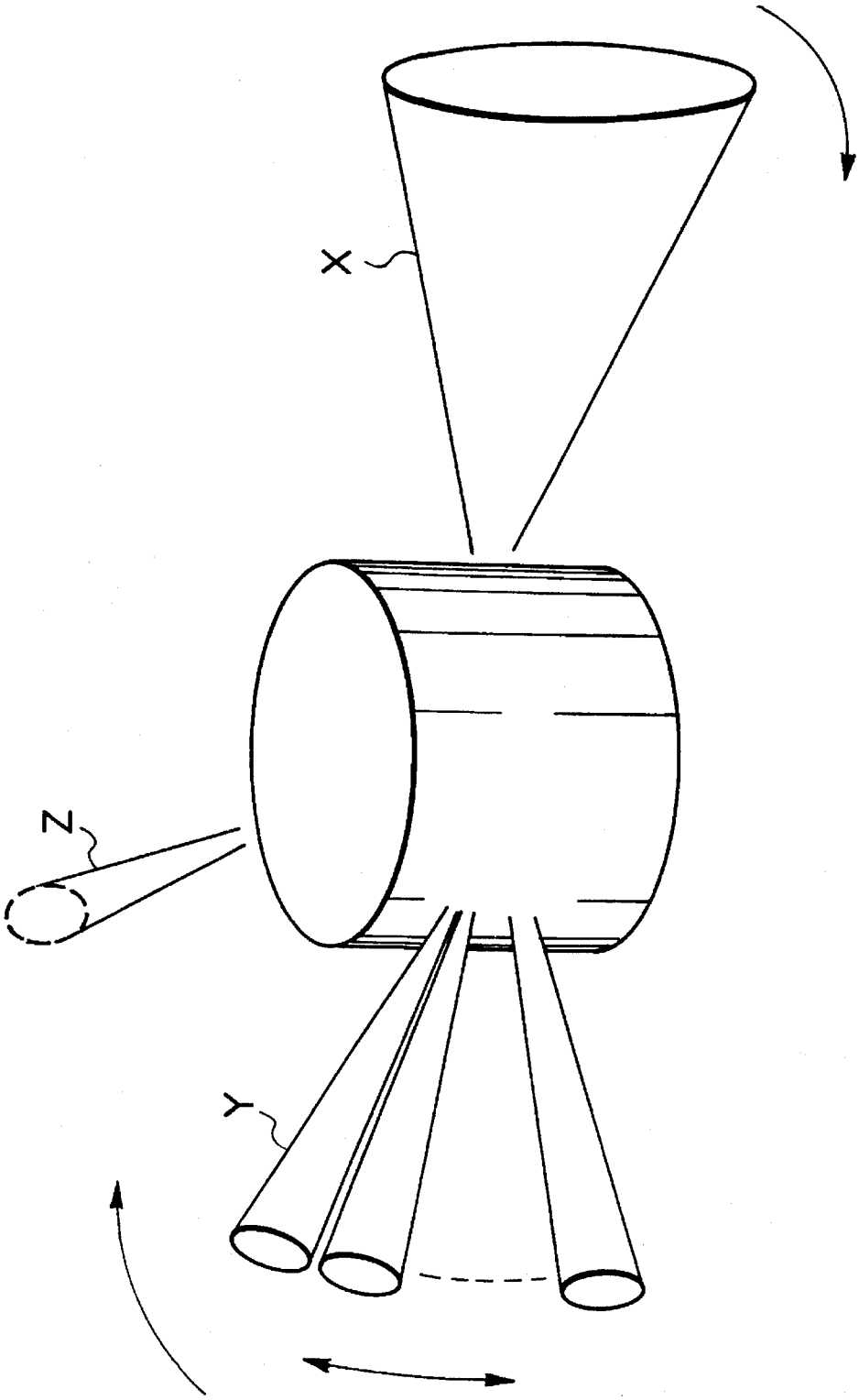
FIG. 13 is a diagram illustrating scanning beams produced by the radar system of FIG. 11.

In FIG. 11, when the switching circuit 1300 is in a state as shown in FIG. 11, the column arrays 1101 through 1108 are selected. During a transmitting mode, a fan type beam as indicated by an arrow X in FIG. 13 can be formed by the low frequency phased array antenna portion of the apparatus of FIG. 11. The fan-type beam is scanned along the azimuth direction. Also, a pencil-type beam as indicated by an arrow Y in FIG. 13 can be formed by the high frequency phased array antenna portion of the apparatus of FIG. 11. The pencil-type beam is scanned in the elevation and azimuth direction. Further, since the beam direction control of the high frequency phased array antenna portion of the apparatus of FIG. 11 is time-divisionally carried out, a tracking beam as indicated by an arrow Z in FIG. 13 can be formed.

Also, note that the above-described embodiment can be also applied to a planer phased array antenna. Further, the distributor 10 and the combiner 11 can be provided for one column, or three or more columns of the low frequency phased array antenna elements.

As explained hereinbefore, according to the present invention, since the number of transceiver modules is reduced, the antenna apparatus can be reduced in size and cost. Also, the low frequency phased array antenna elements can be operated to form a fan-type scanning beam a searching time for the entire angle coverage can be reduced. Further, a searching performance for a distant object and an acquisition and tracking performance for a near object can be improved. Still further, since two antenna systems are provided, even when one is troubled, the other can be normally operated, to thereby improve the operability of a radar system.

What is claimed:

1. A dual band array antenna apparatus comprising:

a plurality of first phased array antenna elements for a first frequency, said first phased array antenna elements being arranged in rows and columns;

a plurality of second phased array antenna elements for a second frequency, the second frequency being higher than the first frequency, said second phased array antenna elements being arranged in rows and columns;

a plurality of first transceiver modules, each provided for one of said columns of said first phased array antenna elements;

a plurality of distributing and combining units, each connected to one of said first transceiver modules and the corresponding first phased array antenna elements, said distributing and combining units including microstrip lines having different delay times; and a plurality of second transceiver modules, each connected to one of said second phased array antenna elements;

every column of said first phased array antenna elements being operated to form a fan beam, the fan beam being scanned only in an azimuth direction;

said second phased array antenna elements being operated to form a pencil beam, the pencil beam being scanned both in an elevation direction and an azimuth direction.

2. An apparatus as set forth in claim 1, wherein said first phased array antenna elements are superimposed on said second phased array antenna elements.

3. An apparatus as set forth in claim 2, wherein each of said first phased array antenna elements is a mesh, and each of said second phased array antenna elements is a patch.

4. An apparatus as set forth in claim 1, further comprising:

a plurality of first transmission lines, each connected to a plurality of said second transceiver modules, for distributing a transmission signal to the plurality of said second:transceiver modules; and a plurality of second transmission lines, each connected to the plurality of said second transceiver modules, for combining a reception signal from each of the plurality of said second transceiver modules.

5. An apparatus as set forth in claim 1, wherein said first and second phased array antenna elements and said distributing and combining units are arranged on a cylinder.

6. A dual band array antenna apparatus comprising:

first, second, third and fourth dielectric substrates which are superimposed;

a plurality of columns of first phased array antenna elements being on said first dielectric substrate, for a first frequency;

a plurality of columns of second phased array antenna elements being on said second dielectric substrate, for a second frequency, the second frequency being higher than the first frequency;

a first ground plane on said third dielectric substrate;

a plurality of distributing and combining circuits being on said fourth dielectric substrate, each of said distributing and combining circuits being connected to one column of said first phased array antenna elements;

a second ground plane below said fourth dielectric substrate;

a plurality of first transceiver modules each connected to at least one of said distributing and combining circuits;

a plurality of second transceiver modules, each connected to one of said second phased array antenna elements; and a plurality of transmission lines, each connected to one of said second transceiver modules;

said first phased array antenna elements being operated to form a fan beam, the fan beam being scanned only in an azimuth direction, said second phased array antenna elements being operated to form a pencil beam, the pencil beam being scanned in an elevation direction and an azimuth direction.

7. An apparatus as set forth in claim 6, wherein each of said distributing and combining circuits includes:

a first microstrip line connected to one of said first transceiver modules;

a plurality of second microstrip lines connected to one of said first phased array elements, lengths of said second microstrip lines being different from each other;

a plurality of first couplers, linked between said first microstrip line and one of said second microstrip lines;

a first chip resistor serving as a resistive terminator, connected to an end of said first microstrip line; and a plurality of chip resistors serving as resistive terminators, each connected to an end of one of said second microstrip lines.

8. An apparatus as set forth in claim 7, wherein the lengths of said second microstrip lines are changed to obtain a desired phase distribution at said first phased array antenna elements.

9. An apparatus as set forth in claim 7, wherein coupling factors of said first couplers are changed to obtain a desired amplitude distribution at said first antenna elements.

10. An apparatus as set forth in claim 6, wherein each of said transmission lines includes:

a first conductor;

a plurality of second conductors each connected to one of said second transceiver modules;

a plurality of second couplers linked between said first conductor and one of said second conductors;

a first resistor serving as a resistive terminator, connected to an end of said first conductor; and a plurality of second resistors serving as resistive terminators, each connected to an end of one of said second conductors.

11. An apparatus as set forth in claim 10, wherein delay times of said second conductors are changed to obtain a desired phase distribution at said second phased array elements.

12. An apparatus as set forth in claim 10, wherein coupling factors of said second couplers are changed to obtain a desired amplitude distribution at said second antenna elements.

13. Art apparatus as set forth in claim 6, wherein each of said first phased array antenna elements is a mesh, and each of said second phased array antenna elements is a patch.

14. An apparatus as set forth in claim 6, wherein said first and second phased array antenna elements and said distributing and combining circuits are arranged on a cylinder.

* * * * *